United States Patent [19]

Fujita

[11] 4,253,212

[45] Mar. 3, 1981

[54] TRAINING APPLIANCE FOR TOOTH BRUSHING

[76] Inventor: Kinya Fujita, 326 Nagasawa, Yokosuka-shi, Kanagawa-ken, Japan

[21] Appl. No.: 42,932

[22] Filed: May 29, 1979

[51] Int. Cl.[3] ..... A46B 15/00

[52] U.S. Cl. ..... 15/167 R; 434/263

[58] Field of Search ..... 35/22 R, 23 R; 132/84 R, 84 B; 340/686; 200/61.45 R, 61.52, 61.53; 15/105, 167 R

[56] References Cited

U.S. PATENT DOCUMENTS

| | | | |
|---|---|---|---|
| 2,877,477 | 3/1959 | Levin | 15/105 |
| 3,261,978 | 7/1966 | Brenman | 15/167 R |
| 4,163,300 | 8/1979 | Quint | 200/61.52 |

*Primary Examiner*—Peter Chin

*Attorney, Agent, or Firm*—Blanchard, Flynn, Thiel, Boutell & Tanis

[57] ABSTRACT

A sound emitting device and/or a light emitting device actuated by brushing movement are provided in the stem of a tooth brush. These devices sense the reciprocating motion and the rotational motion of the brush, and the pressure applied on brushing.

The sound emitting device comprises a hollow cylindrical body connected to the stem of the brush and a ball like or columnar movable piece accommodated in the hollow cylindrical body, wherein the movable piece is moved by the motion of the brush in the direction of the axis of the brush so as to hit the end of the inner surface of the hollow cylindrical body for emitting sound. Alternatively, an electrode is provided on the inner wall of the hollow cylindrical body and an electro-conductive movable piece contacts the electrode to form an electrical circuit for emitting sound. For the rotation of the axis of the tooth brush, the movable piece contacts the electrode and a sound is emitted. Instead of the sound emitting device or simultaneously with it, the light emitting device may be operated. To sense a pressure during the tooth brushing an electrical conductive electrode is buried in the stem of the tooth brush or a sensor composed of a pressure sensing element and the like may be buried in the stem.

2 Claims, 24 Drawing Figures

TRAINING APPLIANCE FOR TOOTH BRUSHING

BACKGROUND OF THE INVENTION

The present invention relates to a tooth brushing training appliance using a tooth brush for cleaning the mouth cavity. Particularly, the present invention relates to an appliance for training the proper tooth brushing method, pressure, time and frequency and the like.

Making the mouth clean has the effect of maintaining the health of the teeth supporting tissue and protecting the teeth from decay. Further, it is important for avoiding halitosis and maintaining the beauty of the teeth.

As methods for making the mouth clean, various methods such as the mechanical, chemical and like methods have been considered previously. Among these methods, the simple, easy and the most general one is to clean the teeth with a tooth brush.

However, considering the frequency of conditions of disease, such as tooth decay and the disease of the teeth supporting tissue at present, it appears that the correct tooth brushing is not necessarily carried out. It is of course due to insufficient thought about dental hygiene. However, it also depends on the difficulty of ascertaining whether a correct tooth brushing method itself is carried out or not. Especially, when the subject of the tooth brushing training method is an infant, it is still further difficult. If the infant is trained incorrectly, he or she will acquire a poor habit and will be unable to alter the habit when grown up.

BRIEF SUMMARY OF THE INVENTION

The kind of the brush, the brushing method, applied pressure on brushing, the frequency of the brushing and the like are very important factors in mouth cleaning using a tooth brush.

Briefly, the present tooth brushing appliance comprises a sound emitting device and/or a light emitting device, operated by the tooth brushing movement and provided in the stem of the tooth brush. These devices include a ball like or columnar movable piece accomodated in the hollow cylindrical member formed in the stem of the brush, said movable piece being moved by the movement of the tooth brush in the direction of the axis so as to hit the end surface of the hollow cylindrical member for emitting a sound, or an electro-condutive movable piece is made to contact an electrode provided on the inner surface of the hollow cylindrical member to emit a sound. For the rotation of the axis of the brush, the electrode provided on the inner surface of said hollow cylindrical member contacts with the electro-conductive movable piece to emit a sound. In place of the sound emitting device, a light emitting device may be used and operated in the same way as the sound emitting device. For detecting the pressure at the time of brushing, a pressure sensing device of an electro-conductive contact, a pressure sensing element and the like is buried into the stem of the brush. Otherwise, in the joint member of the stem of the tooth brush and the sound emitting or the light emitting device, a sensor composed of the said contact, pressure sensing element and the like may be provided for operating said sound emitting device or light emitting device by sensing the deformation of the stem of the brush.

As is obvious from the description given above, the main object of the present invention is to provide an appliance for training a correct tooth brushing method employing a tooth brush and further ascertaining whether the correct tooth brushing technique is being carried out or not.

Another object of the present invention is to provide an appliance for making young children and school children study the correct tooth brushing technique enthusiastically and making the correct tooth brushing technique a habit.

A further object of the present invention is to provide an appliance by which men and women having eye or ear troubles can study the correct tooth brushing method and acquire it easily, whereby the instruction of tooth brushing of such persons may be accomplished more easily.

Other objects and advantages of the present invention will be apparent from the description given hereinafter referring to the attached drawings.

DETAILED DESCRIPTION

Figure 1:
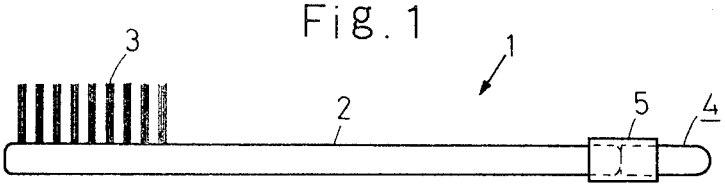
FIG. 1 is a sectional view of the tooth brush according to the present invention.

In FIG. 1, the reference number (1) indicates an ordinary tooth brush which is composed of a stem (2) having a suitable elasticity such as plastic or bamboo and the tooth brush main portion (3) having bristles implanted on the stem (2). The tooth brushing training appliance (4) according to the present invention is connected by a connecting member (5) of rubber, plastic or metal to the end opposite to said brush main portion (3) of the stem (2).

Figure 3:
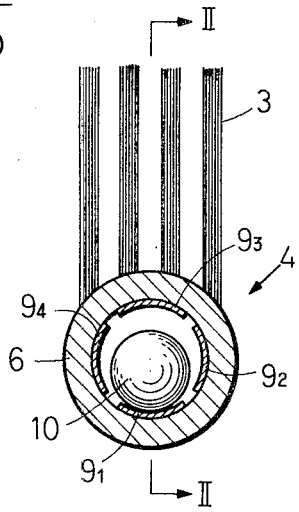
FIG. 3 is the sectional view, taken along the line III—III of FIG. 2, of the tooth brushing training appliance according to the present invention.
Figure 2:
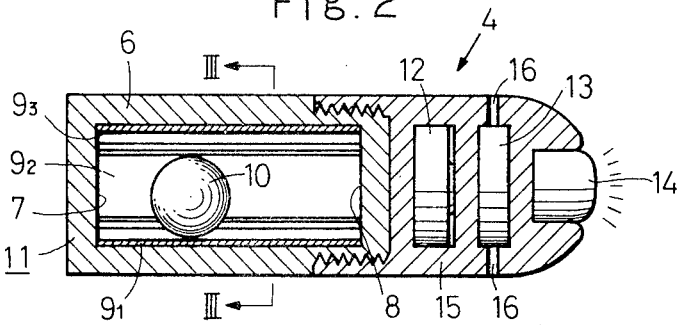
FIG. 2 is the sectional view, taken along the line of II—II of FIG. 3, of the tooth brushing training appliance according to the present invention.

The tooth brushing training appliance (4) according to the present invention is comprised of a hollow cylindrical member (6) having two end walls (7) (8) as shown in FIGS. 2 and 3.

Figure 5:
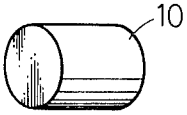
FIG. 5 is an oblique view of a movable piece in the form of cylinder.

The electrodes ($9_1$), ($9_2$), ($9_3$) and ($9_4$) are four axially extending portions adhered to the inner wall of the cylindrical member (6) in circumferentially spaced-apart relation to provide a suitable gap between respective neighboring two electrodes. A movable piece (10), which is like a ball or a cylinder of electro-conductive metal, as shown in FIG. 5, is received inside the hollow cylindrical member (6). A reciprocating sound emitting device (11) is formed in such a way that the movable piece (10) slides inside the hollow cylindrical member (6) and hits both end walls (7) (8) for emitting sound. A housing (15) accommodating a battery (12), a sound emitting device (13), and a light emitting device (14) is screwed into one end of said hollow cylindrical member (6).

Figure 4:
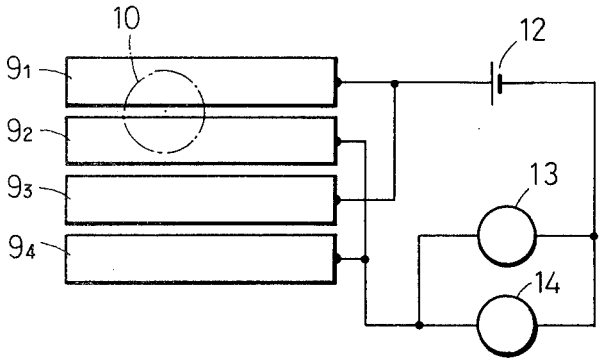
FIG. 4 is an electric circuit diagram showing the connection of the rolling electrode, the cell, the light emitting device and the light emitting device.

As shown in FIG. 4, said first and third electrodes ($9_1$), ($9_3$) are connected to one terminal of the battery (12), while said second and fourth electrodes ($9_2$), ($9_4$) are connected to the other terminal of the battery through said sound emitting device (13) and said light emitting device (12).

Concretely, said sound emitting device (13) comprises a buzzer, and a sound hole (16) is provided on the side surface of the housing (15). The light emitting device (14) is composed of a lamp, a neon tube, a light emitting diode and the like partially exposed on the end surface of the housing (15).

The tooth brushing action using the tooth brush (1) with the tooth brushing training appliance (4) will be described hereinafter.

When the teeth are brushed by the reciprocating motion of the tooth brush (1), the proper tooth brushing method can be acquired with assurance by brushing the teeth at a properly slow speed of the reciprocating motion so that the movable piece (10) is not moved axially, that is, it does not hit both end walls (7), (8) for emitting any sound. Further, the bad results due to the conventional high speed tooth brushing, such as incomplete cleaning, wear and the damage of the gums of the mouth can be avoided.

When tooth brushing is effected by rolling the tooth brush (1) the movable piece (10) rolls or slides inside the hollow cylindrical member (6), shorting the electrodes ($9_1$), ($9_2$), ($9_3$) and ($9_4$), operating the sound emitting device (13), and turning on and off the light emitting device (14).

Therefore, correct tooth brushing motion can be acquired through sufficient rolling by hearing the sound emitted or seeing the light going on and off reflected by a mirror.

Figure 6:
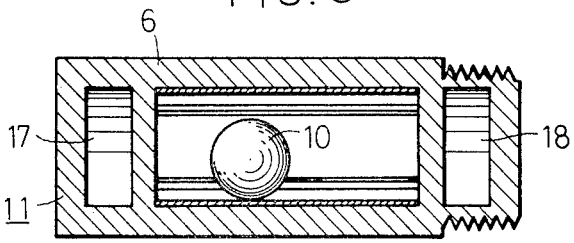
FIG. 6 is a sectional view of an embodiment of the present invention in which two resonance chambers are provided at the respective ends of the hollow cylindrical member.

As shown in FIG. 6, resonance chambers (17), (18) may be provided at both ends of the hollow cylindrical member (6) composing the reciprocating sound emitting device.

Figure 7:
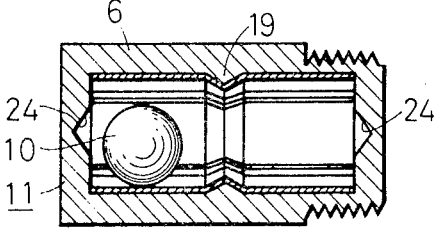
FIGS. 7 and 8 are sectional views of embodiments of the present invention each of which shows a projection provided for restricting the movement of the movable piece within the hollow cylindrical member in different ways.
Figure 8:
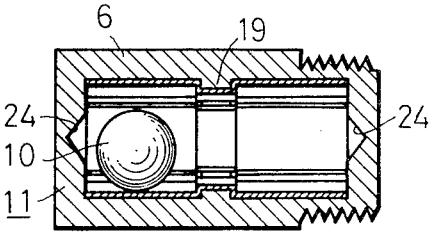

When the movable piece (10) moves too easily due to the linearly constructed inner surface of the hollow cylindrical member (6), the inner wall of the cylinder (6) and the movable piece (10) may be made resistive to each other. Concretely, a resisting member (19) having a triangular section as shown in FIG. 7 or a square section as shown in FIG. 8 is provided, or the surface of the movable piece (10) is made rough for retarding the sliding motion of the piece.

Figure 9:
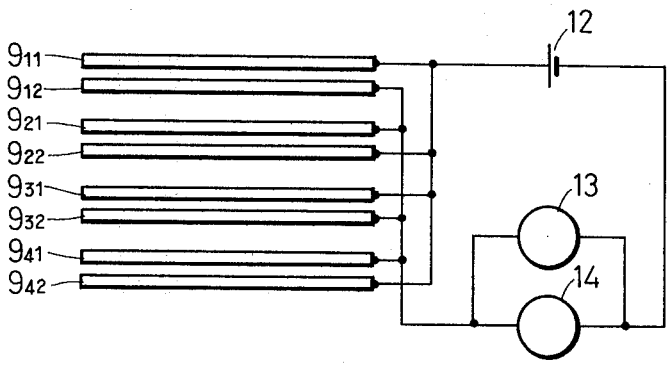
FIG. 9 shows an electrical circuit diagram of an embodiment in which four sets of electrodes for detecting the rolling which one set is composed of two electrodes.
Figure 10:
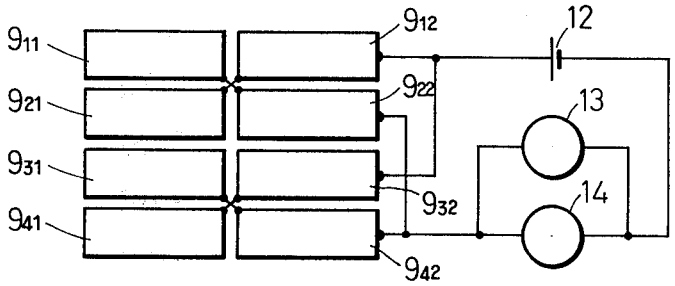
FIG. 10 is an electrical circuit diagram of an embodiment of the present invention wherein the rolling detecting electrodes' are divided in the longitudinal direction also for detecting the reciprocating motion.

The electrodes adhered to the inner wall of the hollow cylindrical body may be constructed as shown in FIG. 9 or 10. FIG. 9 shows the case wherein each set of electrodes ($9_{11}$) and ($9_{12}$), ($9_{21}$) and ($9_{22}$), ($9_{31}$) and ($9_{32}$), and, ($9_{41}$) and ($9_{42}$) are composed of two electrodes. The neighboring electrodes ($9_{12}$)($9_{21}$), ($9_{22}$)($9_{21}$), ($9_{32}$)($9_{41}$) and ($9_{42}$)($9_{11}$) are connected so as not to operate even if these neighboring electrodes are shorted to each other. FIG. 10 shows the case wherein electrodes ($9_1$), ($9_2$), ($9_3$) and ($9_4$) shown in FIG. 4 are cut into half, and the electrodes ($9_{11}$) and ($9_{22}$), ($9_{21}$) and ($9_{12}$), ($9_{31}$) and ($9_{42}$), and ($9_{41}$) and ($9_{42}$) are connected to each other. In this embodiment, the reciprocating motion of the movable piece may also be detected.

Figure 11:
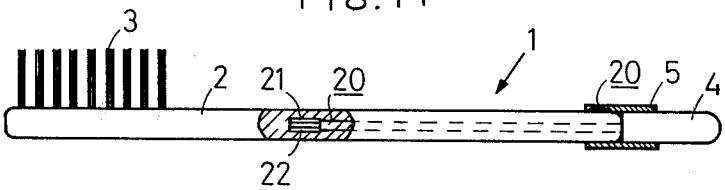
FIG. 11 is a side view showing an embodiment wherein a pressure detecting sensor is provided inside or outside of the stem of the tooth brush.

FIG. 11 explains how a pressure detecting device (20) operates. The stem (2) of the tooth brush (1) is generally elastic and may be deflected if a force larger than the predetermined value is applied.

Figure 12:
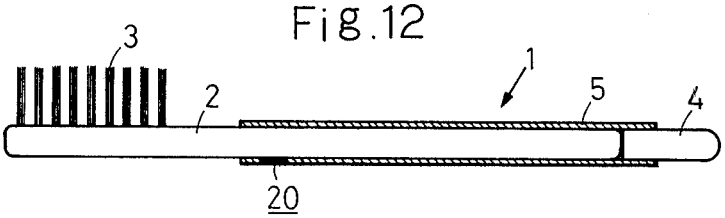
FIG. 12 is a side view showing an embodiment of the present invention wherein a pressure detecting sensor is provided outside of the stem and in the neighborhood of the portion where the bristles are implanted and covered with an elongated connecting member.
Figure 13:
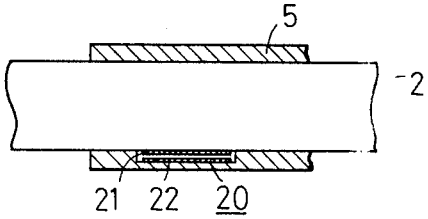
FIG. 13 is an enlarged view of a fragment of FIG. 12.

For detecting this deflection, sensors (21), (22) such as pressure sensitive elements, electrodes and the like, opposing each other are buried especially at a place inside the stem where the deflection is easily caused. The sensor may be connected to the sound emitting device (13) and the light emitting device (14) as shown in FIGS. 14–24. The pressure detecting device (20), is not restricted to being located in the stem (2) of the tooth brush (1), and it may be located between the connecting member (5) and the stem (2) or the hollow cylindrical member (4) as shown in FIG. 11. Further, the pressure detecting device (20) directly may be provided in the connecting member (5) by making said connecting member (5) sufficiently longer as shown in FIG. 12. FIG. 13 shows an enlarged view of the pressure detecting device (20) placed between the stem (2) and the connecting member (5).

In the construction described above, deformation of the stem (2) of the tooth brush is detected, and a suitable tooth brushing pressure can be acquired by the sound from the sound emitting device (13) and the light emitted by the light emitting device (14).

FIGS. 14 to 24 are various circuit diagrams showing the connection of the battery (12), a group of switches ($23_1$)($23_2$) . . . ($23_n$) composed of the movable piece (10), the pressure detecting device (20), the sound emitting device (13) and the light emitting device (14).

Figure 14:
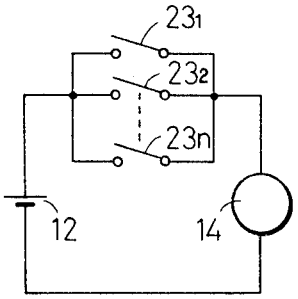
FIGS. 14 to 24 are electrical circuit diagrams of various embodiments of the present invention wherein the rolling and reciprocating motion detecting switches, the pressure detecting device, the light emitting device, the sound emitting device and the cell are combined and mutually connected in different ways.

FIG. 14 shows an embodiment in which the light emitting device (14) is connected to the switches ($23_1$) . . . ($23_n$) connected in parallel. If any one of the switches ($23_1$) . . . ($23_n$) is shorted, the light emitting device is turned on and off.

Figure 15:
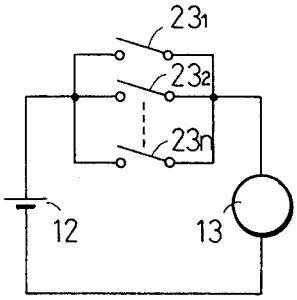

FIG. 15 shows an embodiment wherein the sound emitting device (13) is connected to the switches ($23_1$) . . . ($23_n$) connected in parallel, and if any one of the switches ($23_1$) . . . ($23_n$) is shorted, the sound emitting device (13) is operated.

Figure 16:
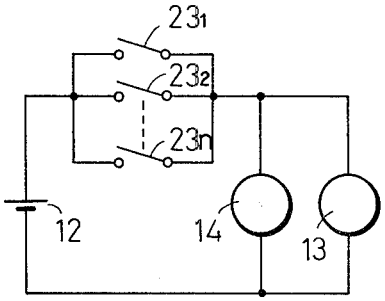

FIG. 16 shows an embodiment wherein the light emitting device (14), connected in parallel with the sound emitting device (13) is connected in series with the group of switches ($23_1$) . . . ($23_n$). If any one of the switches ($23_1$) . . . ($23_n$) is shorted, both of the sound emitting deivce and the light emitting device are operated. The circuit is substantially the same as that in FIG. 4, 9 or 10 shown above.

Figure 17:
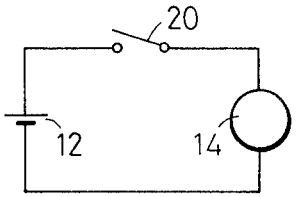
Figure 18:
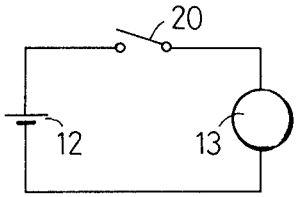
Figure 19:
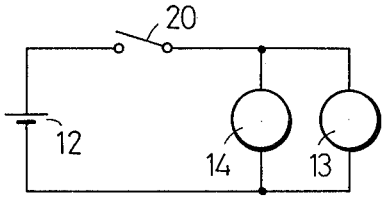

FIG. 17 shows an embodiment in which the light emitting device (14) is connected with the pressure detecting device (20). FIG. 18 shows an embodiment wherein the sound emitting device (13) is connected with the pressure detecting device (20). FIG. 19 shown an embodiment wherein the light emitting device and the sound emitting device (13) connected in parallel are connected to the pressure detecting device (20).

Figure 20:
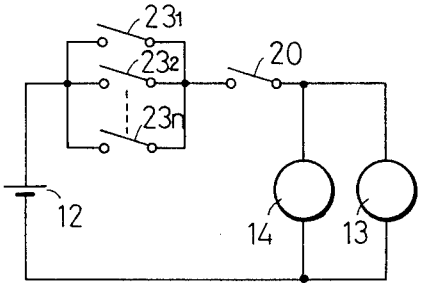

FIG. 20 shows an embodiment the group of the switches ($23_1$) . . . ($23_n$) connected in series with the pressure detecting device (20) is connected to the light emitting device (14) and the sound emitting device (13) connected im parallel. Therefore, when any one of the switches ($23_1$) . . . ($23_n$) and the pressure detecting device (20) are shorted simultaneously the light emitting device (14) and the sound emitting device are operated.

Figure 21:
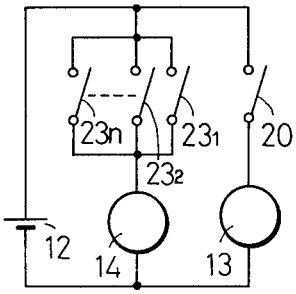

FIG. 21 shows an embodiment wherein the group of switches ($23_1$) . . . ($23_n$) and the light emitting device in series connection are connected in parallel with the pressure detecting device (20) and the sound emitting device (13) connected in series.

Figure 22:
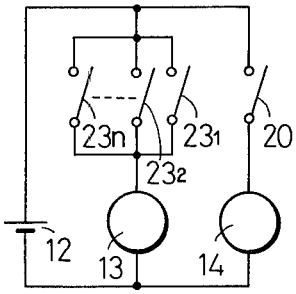
Figure 23:
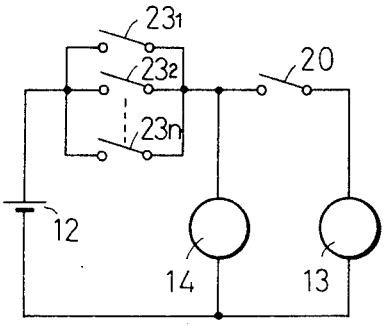

FIG. 22 shows an embodiment in which the cell (12), the switches ($23_1$) . . . ($23_n$), and the light emitting device (14) forming a closed circuit are connected in parallel with the pressure detecting device (20) and the sound detecting device (13) connected in series. In this circuit the light emitting device (14) and the sound emitting device (13) may be interchanged.

Figure 24:
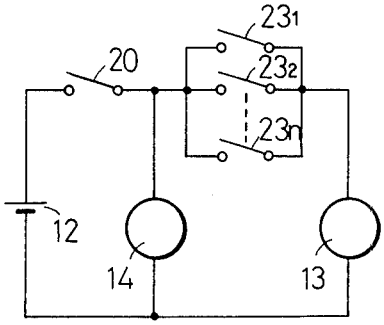

FIG. 24 shows an embodiment wherein the cell (12), the pressure detecting device (20) and the light emitting device (14) form a closed circuit. The light emitting device (14) is connected in parallel with the switches ($23_1$) . . . ($23_n$) connected in series with the sound emitting device (13). In this embodiment, the light emitting device and the sound emitting device may also be interchanged.

For avoiding the consumption of the battery when the tooth brush is not used, it is desirable to prevent the movable piece (10) from shorting the electrodes ($9_1$)($9_2$), ($9_3$) and ($9_4$). For this purpose as shown in FIG. 3, when the tooth brush bristle portion is facing upward, the electrodes ($9_1$), ($9_2$), ($9_3$) and ($9_4$) are so arranged that they may not be shorted by the movable piece (10), or the brush (1) may be hung vertically. The engagement indented portions (24) are formed on both end walls of the hollow cylindrical member (6) as shown in FIGS. 7 and 8 so that the movable piece (10) does not contact the electrodes ($9_1$), ($9_2$), ($9_3$) and ($9_4$) when the brush is leaned against something.

When the tooth brush (1) is to be laid stably, it may be also possible to twist the electrodes ($9_1$), ($9_2$), ($9_3$) and ($9_4$) between the stem (2) and the hollow cylindrical member (6) so that the mutual positions of the electrodes ($9_1$), ($9_2$), ($9_3$) and ($9_4$) may be adjusted so that the movable piece (10) does not short said electrodes.

The tooth brush (1) may be composed so that the stem (2) of the brush may be freely attached to or removed from the connecting member (5). Therefore, when the tooth brush (1) is not used, the stem (2) of the tooth brush (1) and the connecting member (5) may be separated. Further, a switch (not shown) may be provided in series with the battery (12).

In the embodiments described above, the stem (2) of the tooth brush (1) is joined to the hollow cylindrical member (6) with the connecting member (5). However, without using the connecting member (5) the present invention can be applied without any modification to the cases where the stem and the cylindrical member are screwed in each other or closely fitted, or the stem (2) is formed with the hollow cylindrical member (6) as one body.

What I claim is:

1. A tooth brushing training appliance, comprising: a tooth brush composed of an elongated stem adapted to be grasped by the human hand and a head portion at one end of said stem, said head portion having bristles attached to one face thereof and adapted to be inserted into the mouth of a human being for brushing teeth; a hollow cylindrical body mounted on the opposite end of said stem, said body having an elongated internal cavity which extends lengthwise of said stem and which has a longitudinally extending side wall; a plurality of circumferentially spaced-apart, longtiudinally extending electrodes mounted on the internal surface of said side wall, a movable electrically conductive member disposed inside said cavity for lengthwise movement in said cavity between the ends thereof when said body is inclined with respect to the horizontal and for lateral movement in said cavity when said body is moved arcuately around its lengthwise axis so that said electrically conductive member contacts two adjacent electrodes to provide an electrical connection therebetween; an electrically operated light emitting device mounted on said body, an electrically operated sound emitting device mounted on said body, a battery mounted on said body, an electrical circuit connecting said battery in circuit with said electrodes and said light emitting device and said sound emitting device so that said devices are actuated when said electrically conductive member contacts two adjacent electrodes in said cavity.

2. A tooth brushing training appliance as claimed in claim 1 including pressure sensor switch means responsive to flexing of said stem, said pressure sensor switch means being connected in said electrical circuit for actuating said devices in response to flexing of said stem.

* * * * *